US008500359B2

(12) United States Patent
Yeo

(10) Patent No.: US 8,500,359 B2
(45) Date of Patent: Aug. 6, 2013

(54) NONSTOP TRAFFIC SYSTEM USING HALF (1/2) CLOVERLEAF AND TRAFFIC METHOD APPLIED WITH THE SAME

(76) Inventor: Chi Hong Yeo, Seoul (KR)

( * ) Notice: Subject to any disclaimer, the term of this patent is extended or adjusted under 35 U.S.C. 154(b) by 0 days.

(21) Appl. No.: 13/132,924

(22) PCT Filed: Dec. 2, 2009

(86) PCT No.: PCT/KR2009/007134
§ 371 (c)(1),
(2), (4) Date: Jun. 5, 2011

(87) PCT Pub. No.: WO2010/064834
PCT Pub. Date: Jun. 10, 2010

(65) Prior Publication Data

US 2011/0243657 A1 Oct. 6, 2011

(30) Foreign Application Priority Data

Dec. 5, 2008 (KR) ..... 10-2008-0122821

(51) Int. Cl.
*E01C 1/04* (2006.01)

(52) U.S. Cl.
USPC ..... 404/1

(58) Field of Classification Search
USPC ..... 404/1; 52/174
IPC ..... E01C 1/04
See application file for complete search history.

(56) References Cited

U.S. PATENT DOCUMENTS 1,543,080 A * 6/1925 Graves ..... 404/1
3,238,854 A * 3/1966 Okubo ..... 404/1

(Continued)

FOREIGN PATENT DOCUMENTS

JP 2000-008305 * 1/2000
JP 2001-003303 * 1/2001

(Continued)

OTHER PUBLICATIONS

International Search Report for PCT/KR2009/007134 mailed Aug. 5, 2010.

*Primary Examiner* — Gary Hartmann
(74) *Attorney, Agent, or Firm* — Christopher Paul Mitchell

(57) ABSTRACT

Disclosed is a nonstop traffic system using a half (½) cloverleaf and a traffic method applied with the same, including a loop-type traffic system for connecting a half (½) cloverleaf (100) to half (½) underground U-turn lanes (200E, 200W, 200S and 200N) that can make vehicles drive and pedestrians walk nonstop in every direction without relation to traffic signals at existing intersections or roadways for left-turn and U-turn, and crosswalks. The half (½) cloverleaf (100) is constructed at existing intersections and the half underground U-turn lanes (200E, 200S, 200S and 200N) are constructed on left-turn roadways in existing four directions (East, West, South and North) that connect to the intersections, U-turn roadways and crosswalks. As mentioned, all structures in the nonstop traffic system using the half (½) cloverleaf in a loop-type that connects the half (½) cloverleaf (100) to the half (½) underground U-turn lanes (200E, 200W, 200S and 200N) in four directions (East, West, South, North) is adopted to the bisectional construction method, thus the height of all lanes can be differentiated. As mentioned, the half (½) cloverleaf (100) includes a half (½) overpass (10), a half (½) underpass (20), a half (½) underground U-turn roadway (30) and a half (½) ground pedestrian bridge (40). Moreover, the half (½) underground U-turn lanes (200E, 200W, 200S and 200N) includes a half (½) overpass (50), a half (½) underground U-turn roadways (60) and half (½).

5 Claims, 5 Drawing Sheets

U.S. PATENT DOCUMENTS

| | | | | |
|---|---|---|---|---|
| 4,592,673 | A * | 6/1986 | Lee | 404/1 |
| 4,986,692 | A * | 1/1991 | Yin-Lung | 404/1 |
| 5,807,020 | A * | 9/1998 | Chen | 404/1 |
| 6,685,386 | B1 * | 2/2004 | Lee | 404/1 |
| 7,234,891 | B2 * | 6/2007 | Niiya et al. | 404/1 |
| 7,473,050 | B2 * | 1/2009 | Liu et al. | 404/1 |
| 7,491,009 | B1 * | 2/2009 | Remy | 404/1 |
| 7,905,681 | B2 * | 3/2011 | Remy | 404/72 |
| 2007/0237576 | A1 * | 10/2007 | Peng | 404/1 |

FOREIGN PATENT DOCUMENTS

| | | | |
|---|---|---|---|
| JP | 2005-264581 | * | 9/2005 |
| WO | 2004/104301 | * | 12/2004 |
| WO | 2005/010278 | * | 3/2005 |
| WO | 2007-133018 | | 11/2007 |
| WO | 2007-133019 | | 11/2007 |

* cited by examiner

NONSTOP TRAFFIC SYSTEM USING HALF (1/2) CLOVERLEAF AND TRAFFIC METHOD APPLIED WITH THE SAME

BACKGROUND

1. Field

An embodiment of the present invention relates to a nonstop traffic system using a half cloverleaf and a traffic method applied with the same, and in particular to a nonstop traffic system which is characterized in that vehicles and pedestrian can always go straight, make a right turn and a U-turn and cross a street in a nonstop way without a vehicle and a pedestrian having a stop for a traffic signal.

2. Description of the Related Art

A roadway prepared for a vehicle is formed of a go straight lane for a vehicle to go straight, a right turn lane, a left turn lane and a U-turn lane.

A right turn can be possible at an intersection without having a right turn signal; however a left turn or a go straight needs a corresponding signal.

For the above operation, a go signal and a stop signal are alternately provided depending on a traffic light in sequence; however in case that vehicles are permitted to go on one lane, the vehicles on the other three lanes are stopped.

Therefore, the vehicles on one lane should wait for at least one signal to many times to go, which interfere a lot with a smooth traffic.

In case that vehicle does not go smoothly based on the signals, the left turn vehicles and go straight vehicles are mixed, thus interfering with a smooth traffic, and causing a car accident in worse cases.

The standby time needed for go is relatively longer, so fuel is over consumed, causing an air contamination problem.

The lane used for a left turn or a U-turn is assigned to a first lane or a second lane which is the same as a go straight lane and is close to the central line, the go straight traffic is a lot interfered with other vehicle.

In case that the vehicles going on the first lane or the second lane want to go straight past the intersection, it is needed to change the lane, thus causing a car accident or a lot of interferences in terms of a traffic.

In light of the foregoing, it is desirable to provide new traffic systems and methods.

BRIEF SUMMARY

Accordingly, the present invention overcomes the aforementioned problems and it is an aspect of the present invention to provide a nonstop traffic system using a half cloverleaf and a traffic method applied with the same characterized in that vehicles and pedestrian can always go straight, make a right turn, a U-turn and cross an intersection without having a standby time for a traffic signal.

It is another aspect of the present invention to provide a nonstop traffic system using a half cloverleaf and a traffic method applied with the same which make it possible for a vehicle driver to save fuel without having a standby time for a traffic signal.

The foregoing and other aspects will become apparent from the following detailed description when considered in conjunction with the accompanying drawing figures.

DETAILED DESCRIPTION

Figure 1:
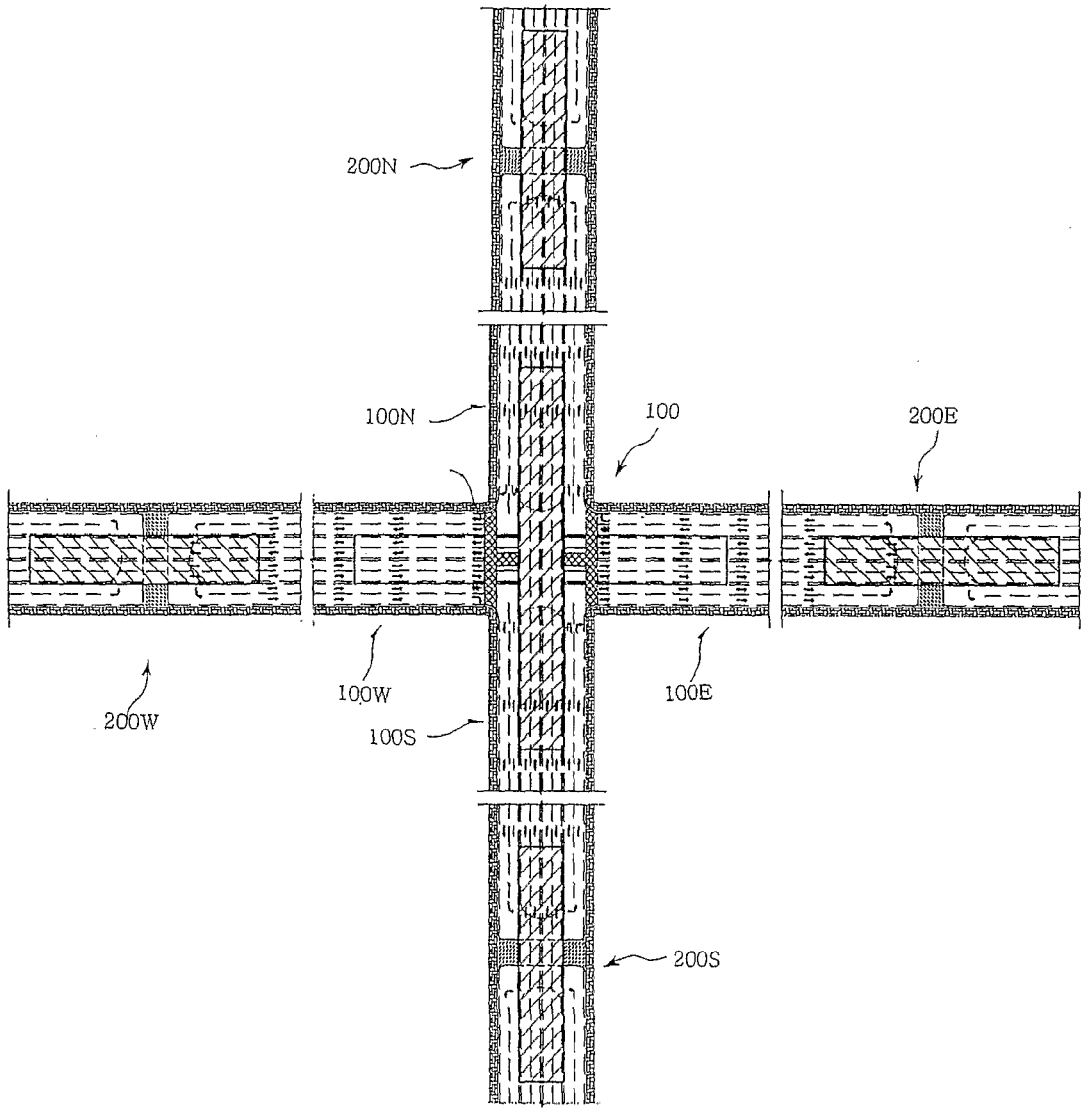
FIG. 1 is a plane view illustrating a nonstop traffic system according to an embodiment of the present invention.

Reference will now be made in detail to embodiments of the present invention, examples of which are illustrated in the accompanying drawings, wherein like reference numerals refer to the like elements throughout. The embodiments are described below to explain the present invention by referring to the figures.

"As used in the description of this application, the terms "a", "an" and "the" may refer to one or more than one of an element (e.g., item or act). Similarly, a particular quantity of an element may be described or shown while the actual quantity of the element may differ. The terms "and" and "or" may be used in the conjunctive or disjunctive sense and will generally be understood to be equivalent to "and/or". Elements from an embodiment may be combined with elements of another. No element used in the description of this application should be construed as critical or essential to the invention unless explicitly described as such. Further, when an element is described as "connected," "coupled," or otherwise linked to another element, it may be directly linked to the other element, or intervening elements may be present.

To achieve the above aspects, there is provided a nonstop traffic system using a cloverleaf, comprising a first roadway providing a go straight; and a second roadway providing a go straight in a direction perpendicular to the first roadway, with a half cloverleaf provided at a cross point where the first roadway and the second roadway cross with each other, the half cloverleaf comprising a half overpass providing a go straight in two directions on the first roadway; a half underground roadway provided below the half overpass and providing a go straight in two directions on the second roadway; a pair of half underground-turn roadways provided below the half overpass and providing a U-turn to the opposite lane of the first roadway before the vehicle goes on the first roadway and enters the second roadway; and a half aboveground cross overpass provided below the half overpass and between the pair of the half underground U-turn roadways and allowing a pedestrian on the second roadway to walk on the opposite lane after crossing the second roadway, and the first roadway forms half underground U-turn roadways at an interval from the half cloverleaf, and the half underground U-turn roadways, each comprising a half overpass providing a go straight in two directions on the first roadway; a half underground U-turn road provided below the half overpass and providing a U-turn to the opposite lane of the first road when a vehicle goes on the first roadway; and a half underground cross roadway provided below the half overpass and in vicinity of the half underground U-turn roadway and providing a crossing below the half overpass; and the second roadway has half underground U-turn roadways at an interval from the half cloverleaf, and the half underground U-turn roadways each comprising a half underground U-turn roadway provided below the half overpass and providing a U-turn to the opposite lane of the second road when a vehicle goes on the second road; and a half underground cross roadway provided below the half overpass and in vicinity of the half underground U-turn roadway and providing a cross below the half overpass.

The half overpass is provided upward higher than the ground surface.

The half underground roadway and the pair of the half underground U-turn roadways are provided at the same heights at the place lower than the ground surface.

The half aboveground overpass is installed lower than the half overpass, but is installed at the same height as the ground surface and higher than the half underground roadway.

The half underground cross roadway is installed lower than the half overpass, but is installed higher than the half underground U-turn roadway and lower than the ground surface.

The nonstop traffic system using a half cloverleaf and a traffic method applied with the same according to an embodiment of the present invention is characterized in that each lane of a half cloverleaf and a half underground U-turn lane are made different in terms of their heights, which makes differences as compared with other direction lanes, thus allowing a vehicle to go in a dedicated direction, so the vehicles going in their directions can go straight, make a right turn, a U-turn and cross an intersection for a pedestrian in a nonstop way without making troubles with other vehicles.

However, in case that a traffic signal broke down due to a natural disaster or a manmade disaster at a conventional traffic system in terms of an intersection, a four-way left turn, a U-turn and an intersection, all the vehicles should stop or a left turn vehicle and a go straight vehicle are mixed, thus making a big traffic congestion, a traffic stagnation or a traffic accident.

The nonstop traffic system using a half cloverleaf and a traffic method applied with the same according to an embodiment of the present invention make it possible to save fuel since a standby time for signal is not needed for a go straight or a lane change which results in decreasing the import of oil and to decrease the generation of carbon dioxide which results in preventing air contamination, thus significantly improving the environment and traffic.

The nonstop traffic system using a half cloverleaf and a traffic method applied with the same according to an embodiment of the present invention are characterized in that a first lane and a second lane close to the central line of a roadway are assigned for a go straight for a long way, and a third lane and a fourth lane are assigned for a direction change the constructions of which detail the functions of each lane, so the driver can easily expect where to go, and a beginner driver or a stranger can drive in full of confidence in driving, so it is possible for most of drivers to drive with a full understanding on the traffic system, thus decreasing a driving time and preventing a traffic accident.

The nonstop traffic system using a half cloverleaf and a traffic method applied with the same according to an embodiment of the present invention can prevent traffic accidents in such a way that the heights of each lane corresponding to a conventional intersection or a left turn lane, a U-turn lane and an intersection roadway are made different for an individual, dedicated driving, thus significantly preventing a traffic accident and a death toll.

Figure 2:
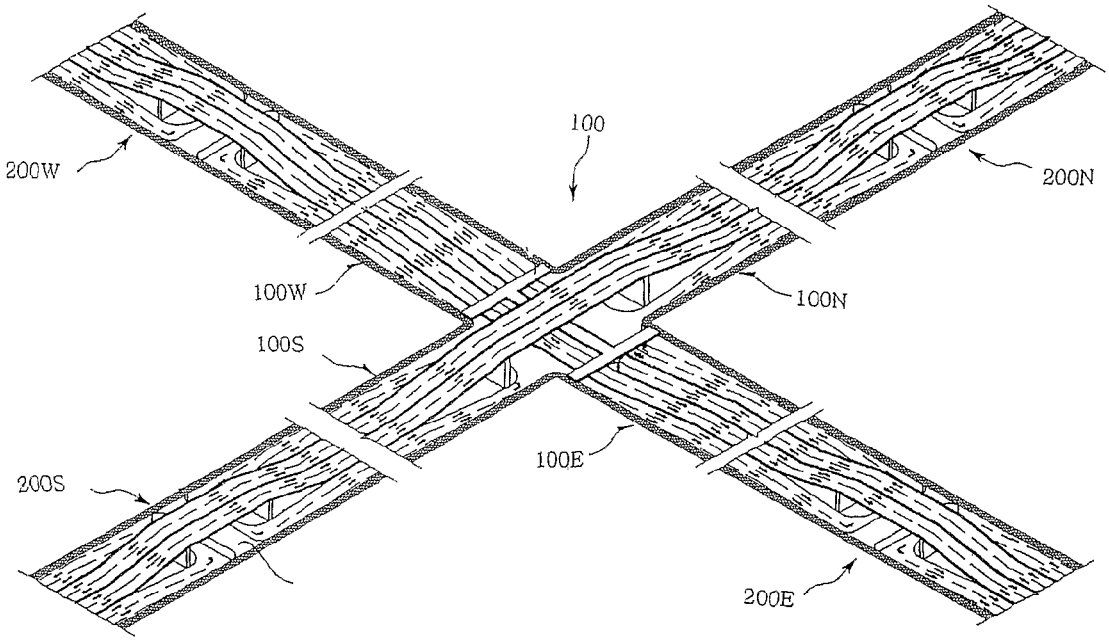
FIG. 2 is a perspective view illustrating a nonstop traffic system according to an embodiment of the present invention.

As shown in FIGS. 1 and 2, the nonstop roadway traffic system according to an embodiment of the present invention comprises a first roadway 1, a second roadway 2, a half cloverleaf 100 and four half underground U-turn roadways 200E, 200W, 200S and 200N.

As shown in FIGS. 1 and 2, the first roadway 1 is designed to make possible a go straight in two directions.

The second roadway 2 is designed to make possible a go straight in a direction perpendicular to the first roadway 1.

The first roadway 1 and the second roadway 2 each have three or four lanes about the central line. The lanes closest to the central line are sequentially called a first lane, a second lane, a third lane and a fourth lane. Here, the first lane and the second lane are assigned for only a go straight lane, and the third lane and the fourth lane are assigned for only a right turn and a U-turn lane.

Figure 3:
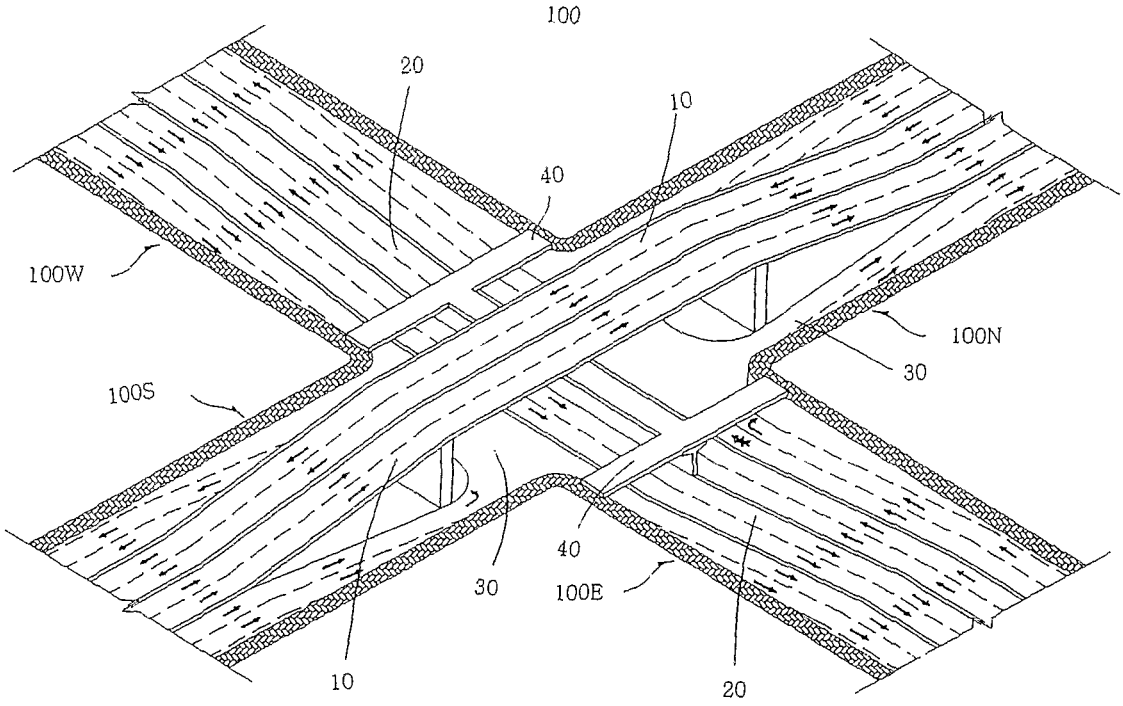
FIG. 3 is a perspective view illustrating a nonstop traffic system using a half cloverleaf according to an embodiment of the present invention.

The half cloverleaf 100 is basically designed for a go straight, a U-turn and a right turn for a vehicle and a crossing for a pedestrian. As shown in FIGS. 2 and 3, the half cloverleaf 100 is constructed in a 3D shape at the intersection of the first roadway 1 and the second roadway 2 and is formed of a half overpass 10, a half underground roadway 20, a pair of half underground U-turn roadways 30 and a half aboveground overpass 40.

The term "half cloverleaf 100" is directed to a structure that one structure is divided into an upper part and a lower part, the upper part of one half is exposed to the ground, and the lower part of the other half is underground, which is characterized from the half structure engineering based on a divide method, so the term is used throughout the specification and claims to represents the above definition. The term "half" contained in the half overpass 10, the half underground roadway 20, the half underground U-turn 30, the half aboveground overpass 40, the half overpass 50, the half underground U-turn roadway 60, and the half underground cross roadway 70 is used for the same purpose The half overpass 10 is designed to allow a go straight in two directions on the first roadway 1, and the height of the lane is protruded higher than the ground surface, and preferably, the height of the same is half of the height of the conventional overpass.

The half underground roadway 20 is provided below the half overpass 10, thus allowing the go straight in two directions on the second roadway 2.

The pair of the half underground U-turn roadway 30 is provided below the half overpass 10, thus allowing the U-turn on the lane opposite to the first roadway 1 before entering the second roadway 2.

The half underground roadway 20 and the pair of the half underground U-turn roadway 30 are installed with the same heights at the place below the ground surface. The height of the lane is preferably half of the depth of the conventional underground roadway The half aboveground cross overpass 40 is formed in a H-shape between the pair of the half underground U-turn roadway 30 at the place below the half overpass 10, thus allowing the pedestrian on the second roadway 2 to walk on the opposite lane while crossing the second roadway 2.

Figure 4:
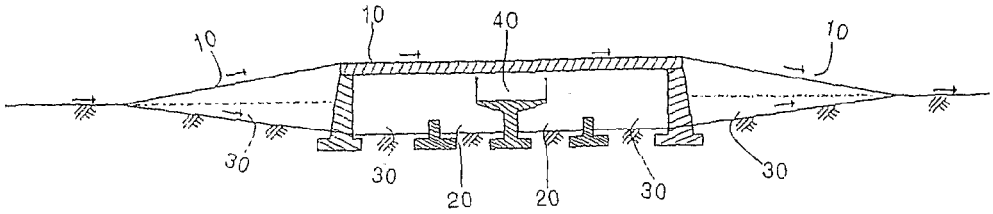
FIG. 4 is a side view illustrating a nonstop traffic system using a half cloverleaf according to an embodiment of the present invention.
Figure 5:
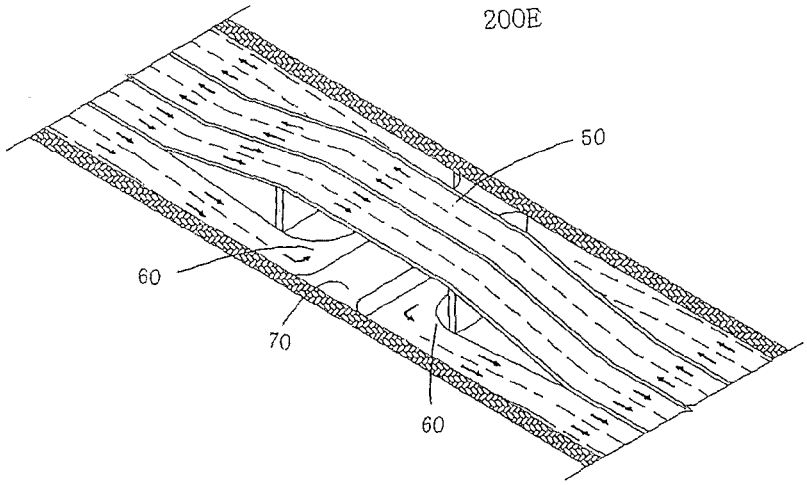
FIGS. 5 to 8 are plane views illustrating a half underground U-turn lane of a nonstop traffic system according to an embodiment of the present invention.
Figure 6:
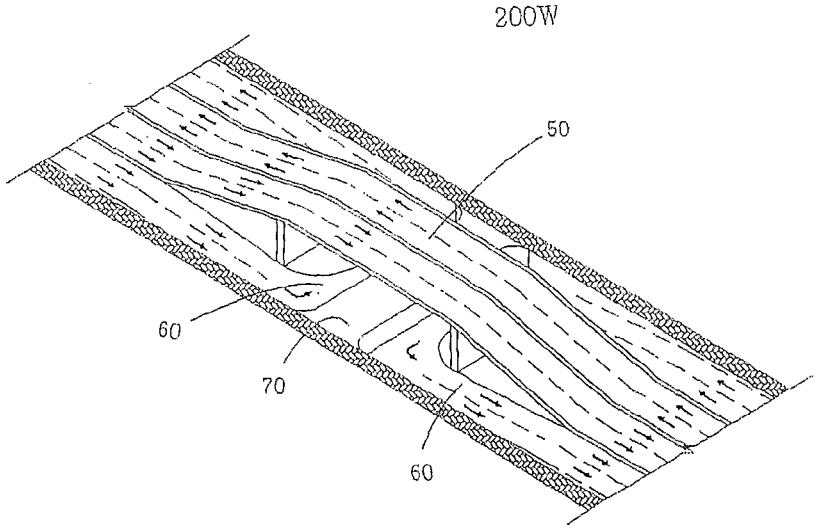

As shown in FIG. 4, the half aboveground cross overpass 40 is constructed lower than the half overpass 10; however it is higher than the half underground roadway 20. As shown in FIG. 3, it is formed in a H-shape, so the pedestrian can freely move to a certain destination on the first roadway 1 and the second roadway 2 without causing an interference with the vehicles.

As shown in FIG. 2, on the first roadway 1 and the second roadway 2 are provided four half underground U-turn roadways 200E, 200W, 200S and 200N each having a certain interval from the half cloverleaf 100

As shown in FIGS. 5 to 8, the half underground U-turn roadways 200S and 200N provided on the first roadway 1 and the half underground U-turn roadways 200E and 200W provided on the second roadway 2 have the same structures, so only the construction of the half underground U-turn roadway 200S provided on the first roadway 1 will be described.

Figure 7:
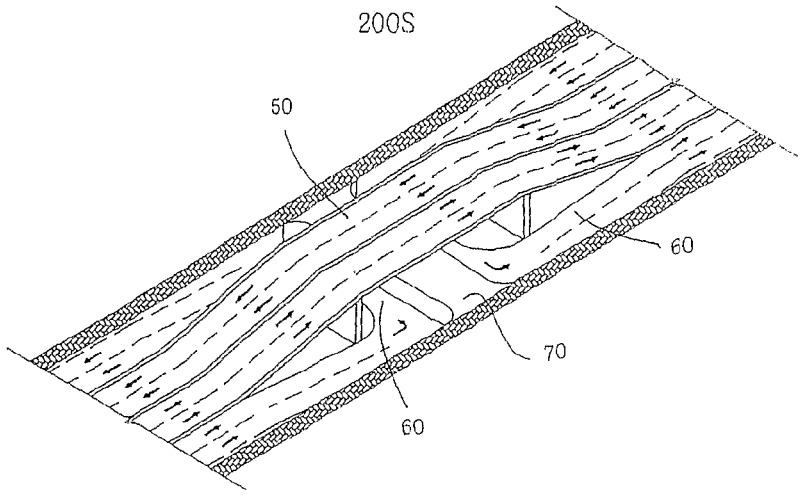
Figure 8:
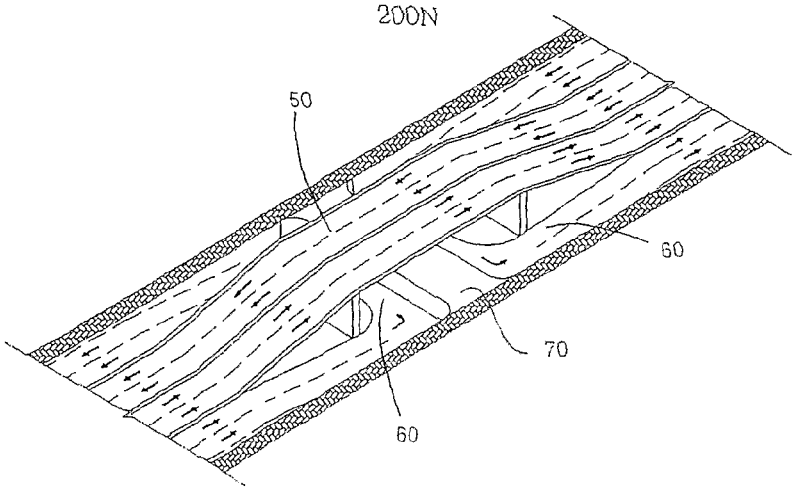

The half underground U-turn roadway 200S is basically directed to a go straight and a U-turn for a vehicle and an intersection cross for a pedestrian. As shown in FIG. 7, it is formed of a half overpass 50, a half underground U-turn roadway 60 and a half underground cross roadway 70

The half overpass 50 is designed for a go straight in two directions on the first roadway 1, and the height of the lane is protruded higher than the ground surface and is half of the height of the conventional overpass.

The half underground U-turn roadway 60 is provided below the half overpass 50, and when a vehicle goes on the first roadway 1, it can make a U-turn to opposite lane of the first roadway 1. The depth of the lane is positioned below the ground surface, and is preferably half of the depth of the conventional underground roadway.

The half underground cross roadway 70 is formed in an I-shape in the vicinity of the half underground U-turn roadway 60 below the half overpass 50, thus crossing the lower side of the half overpass 50.

Figure 9:
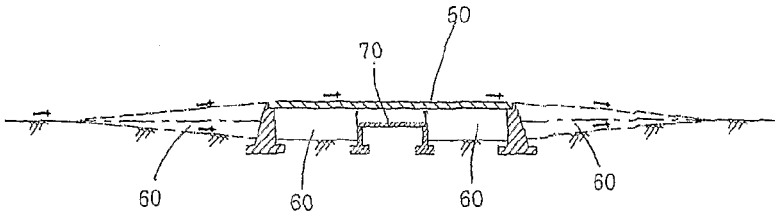
FIG. 9 is a side view illustrating a half underground U-turn lane of a nonstop traffic system according to an embodiment of the present invention.

As shown in FIG. 9, the half underground cross roadway 70 is provided lower than the half overpass 50; however it is provided higher than the half underground U-turn roadway 60, so the pedestrian on the first roadway 1 can freely walk to the opposite lane without having interference with the vehicles.

The operations of the nonstop traffic system according to an embodiment of the present invention will be described.

In the nonstop traffic system implemented in a loop structure connecting the half cloverleaf 100 and the half underground U-turn roadways 200E, 200W, 200S and 200N, the lanes of each roadway have different heights which distinguish from the lanes of another roadway, so the vehicle going in one direction can go straight and make a right turn, a U-turn and a cross walking for a pedestrian in a nonstop way in all directions without having interferences with other lanes. In the following descriptions, the occasion that an embodiment of the present invention is implemented on one lane will be described.

(1) When a vehicle is intended to go from the half underground U-turn roadway 200W to the half underground U-turn roadway 200E, the vehicle goes straight on the half underground U-turn roadway 200W, and keeps going straight to the half underground lane 20 installed at the first and second lanes of the half cloverleaf 100, so it arrived at the half underground U-turn roadway 200E ahead.

(2) When the vehicle is intended to go from the half underground U-turn roadway 200W to the half underground U-turn roadway 200S, the vehicle goes straight on the half underground U-turn roadway 200W, and enters the half underground roadway 20 installed on the third and fourth lanes of the half cloverleaf 100 and then makes a right turn, and goes straight to the half underground U-turn roadway 30 installed on the third and fourth lanes of the half cloverleaf 100, and then finally arrives at the half underground U-turn roadway 200S.

(3) When the vehicle is intended to go from the half underground U-turn roadway 200W to the half underground U-turn roadway 200N, the vehicle goes straight on the half underground U-turn roadway 200W, and keeps going straight on the half underground roadway 20 installed on the first and second lanes of the half cloverleaf 100, and then enters the half underground U-turn roadway 60 installed on the third and fourth lanes of the half underground U-turn roadway 200E, and makes a U-turn at the U-turn points, and goes in the opposite direction, and then makes a right turn at the half underground roadway 20 installed on the third and fourth lanes of the half cloverleaf 100, and goes straight on the half underground U-turn roadway 30 installed at the third and fourth lanes of the half cloverleaf 100, and then finally arrives at the half underground U-turn roadway 200N.

(4) When the vehicle is intended to go from the half underground U-turn roadway 200W to the half underground U-turn roadway 200W of the opposite lane, the vehicle goes straight on the half underground U-turn roadway 200W, and goes straight using the half underground 20 installed on the first and second lanes of the half cloverleaf 100, and enters the half underground U-turn roadway 60 installed at the third and fourth lanes of the half underground U-turn roadway 200E installed ahead, and makes a U-turn at the U-turn point, and goes in the opposite direction, and keeps going straight on the half underground roadway 20 installed at the first and second lanes of the half cloverleaf 100, and then arrives at the half underground U-turn roadway 200W of the opposite lane.

In the nonstop traffic system using a half cloverleaf according to an embodiment of the present invention, the pedestrian who wants to cross the roadway can always cross in a nonstop way without having an interference with the traffic of other lanes by way of the H-shaped half aboveground cross overpass 40 of the half cloverleaf 100 and the I-shaped half underground cross roadway 70 of the half underground U-turn roadways 200E, 200W, 200S and 200N.

In the above, the nonstop traffic system according to the preferred embodiments of the present invention has been described. It is obvious that various changes, corrections or modifications are possible without escaping a scope of the concepts of the present invention.

The invention claimed is:

1. A nonstop traffic system using a cloverleaf, comprising:

a first roadway providing a go straight;

a second roadway providing a go straight in a direction perpendicular to the first roadway, with a half cloverleaf provided at a cross point where the first roadway and the second roadway cross with each other, said half cloverleaf comprising a half overpass providing a go straight in two directions on the first roadway;

a half underground roadway provided below the half overpass and providing a go straight in two directions on the second roadway;

a pair of half underground-turn roadways provided below the half overpass and providing a U-turn to the opposite lane of the first roadway before the vehicle goes on the first roadway and enters the second roadway; and a half aboveground cross overpass provided below the half overpass and between the pair of the half underground U-turn roadways and allowing a pedestrian on the second roadway to walk on the opposite lane after crossing the second roadway, and said first roadway forms half underground U-turn roadways (200S, 200N) at an interval from the half cloverleaf, and said half underground U-turn roadways (200S, 200N) each comprising:

a half overpass providing a go straight in two directions on the first roadway;

a half underground U-turn roadway provided below the half overpass and providing a U-turn to the opposite lane of the first road when a vehicle goes on the first roadway; and a half underground cross roadway provided below the half overpass and in vicinity of the half underground U-turn roadway and providing a crossing below the half overpass; and said second roadway has half underground U-turn roadways (200E, 200W) at an interval from the half cloverleaf, and said half underground U-turn roadways (200E, 200W) each comprising:

a half overpass providing a go straight in two directions on the second roadway;

a half underground U-turn roadway provided below the half overpass and providing a U-turn to the opposite lane of the second road when a vehicle goes on the second roadway; and a half underground cross roadway provided below the half overpass and in vicinity of the half underground U-turn roadway and providing a crossing below the half overpass.

2. The system of claim 1, wherein said overpasses are provided upward higher than a ground surface.

3. The system of claim 1, wherein said half underground roadway and the pair of -U-turn roadways are provided at the same heights at a place lower than the ground surface.

4. The system of claim 1 wherein the half aboveground overpass is installed lower than the half overpass, but is installed at the same height as a ground surface and higher than the half underground roadway.

5. The system of claim 1, wherein said half underground cross roadway is installed lower than the half overpass, but is installed higher than the half underground U-turn roadway 60 and lower than the ground surface.

* * * * *